US006676889B2

(12) United States Patent
Wenghoefer et al.

(10) Patent No.: US 6,676,889 B2
(45) **Date of Patent: *Jan. 13, 2004**

(54) MODULAR FURNACE EMISSION REMEDIATION SYSTEM

(75) Inventors: Hans M. Wenghoefer, East Greenwich, RI (US); John R. Martin, Jr., Slatersville, RI (US); Sheridan A. Glen, Madison, WI (US); James F. Corbett, Mahwah, NJ (US); Richard J. Geier, Emerson, NJ (US)

(73) Assignee: Thermo-Stack L.L.C., Hochessin, DE (US)

( * ) Notice: Subject to any disclaimer, the term of this patent is extended or adjusted under 35 U.S.C. 154(b) by 7 days.

This patent is subject to a terminal disclaimer.

(21) Appl. No.: 10/143,294

(22) Filed: May 10, 2002

(65) Prior Publication Data

US 2003/0013055 A1 Jan. 16, 2003

(Under 37 CFR 1.47)

Related U.S. Application Data

(63) Continuation-in-part of application No. 09/645,504, filed on Aug. 25, 2000, now Pat. No. 6,468,466.

(51) Int. Cl.[7] ..... C21B 7/22

(52) U.S. Cl. ..... 266/148; 266/144

(58) Field of Search ..... 266/144, 148, 266/44

(56) References Cited

U.S. PATENT DOCUMENTS

| | | | | |
|---|---|---|---|---|
| 1,534,324 A | * | 4/1925 | Howard | 266/44 |
| 3,719,471 A | * | 3/1973 | Jones | 266/148 |
| 4,784,603 A | * | 11/1988 | Robak, Jr. et al. | 432/5 |
| 6,245,122 B1 | * | 6/2001 | Meyers | 75/385 |
| 6,468,466 B1 | * | 10/2002 | Wenghoefer et al. | 266/44 |

* cited by examiner

*Primary Examiner*—Scott Kastler
(74) *Attorney, Agent, or Firm*—Barlow, Josephs & Holmes, Ltd.

(57) ABSTRACT

A furnace exhaust remediation unit comprises an auxiliary combustion chamber with a gas burner assembly optimized for efficient and substantially complete combustion of pollutants, for example, waxy hydrocarbons emitted as binder/lubricant substances are driven off in sintering of green powdered-metal parts. The rate of flow of air and exhaust through the combustion chamber are controlled, permitting control of the average residence time of the emissions, ensuring substantially complete combustion. The burner is arranged such that it provides a high-energy exhaust stream directed tangentially into the combustion chamber, so that a spiral motion is provided to the combustible pollutants, improving mixing and heat transfer and thus ensuring efficient combustion of the vaporized hydrocarbon emissions. The system has a universal modular construction where a burn chamber module; a burn chamber extension module and slide gate damper assembly module are provided. The modular construction permits easy customization of the system to lengthen the burn chamber to increase residence times as well as to facilitate assembly, take-down, cleaning and repair of the system.

12 Claims, 4 Drawing Sheets

MODULAR FURNACE EMISSION REMEDIATION SYSTEM

This application is a continuation-in-part of U.S. Ser. No. 09/645,504, filed Aug. 25, 2000, now U.S. Pat. No. 6,468,466.

FIELD OF THE INVENTION

This invention relates to remediation of undesirable emissions from certain common sources. The invention is described in connection with treatment of emissions from heat-treating furnaces used for production of various parts using so-called "powder metallurgy" techniques, but can be used in remediation of emissions from other sources, such as heat treatment of carbon and graphite parts, heat treatment of fabrics, and battery manufacture, among others.

BACKGROUND OF THE INVENTION

"Powder metallurgy" as used herein refers generally to techniques whereby metal parts of relatively complicated shape can be made relatively inexpensively. In a first step, a mold is filled with powders of the constituent materials, mixed with a binder. The filled mold is then commonly subjected to a first low-temperature (e.g., 400° F.) heat treatment, curing the binder, so that the "green part" or "preform" thus formed holds its shape accurately when removed from the mold. The binder materials are chosen so as to also serve a lubricant function, allowing the green part to be readily removed from the mold after this first heat treatment step. The green part is then sintered, that is, subjected to a high temperature heat treatment (e.g., 2300° F. for on the order of minutes or tens of minutes), during which the powders bond securely to one another, forming an essentially finished part. As is well known to those of skill in the art, these parameters vary widely; for example, some sintering processes may take up to 60 hours.

It will be apparent that this process can be much less expensive for forming complex parts than doing so by machining, in that there is little or no waste of material, because materials that are difficult to machine can be formed using these techniques, and because the powder metallurgy process involves reduced manpower and equipment requirements. Consequently, the powder metallurgy industry has grown significantly in recent years.

The typical binder/lubricants are waxy hydrocarbons, such as zinc and lithium stearates, and are commonly provided at 0.5–2% by weight of the green part. Other binder materials can include organic compounds of various proprietary and custom-blended hydrocarbon binder materials. One limitation on the selection of the binder materials is due to the fact that if the furnace exhaust is not properly remediated, the binder materials may result in noxious and odiferous fumes; that is, unless the exhaust is successfully remediated, a preferred binder may not be usable. To remediate exhaust fumes resulting from sintering operations, and thus to allow use of essentially any desired binder material, is accordingly one object of the invention.

More specifically, during the first few minutes of the high-temperature sintering step, the binder/lubricant used to maintain the shape of the green part is driven off and partially decomposed. That is, because a reducing atmosphere is provided within the sintering furnace to prevent oxidation of the parts being sintered, the binder/lubricant, although often nominally combustible, does not burn within the furnace. Therefore, as the binder/lubricant is driven off, waxy emissions, consisting largely of unburned hydrocarbons and like combustible pollutants, are given off, often resulting in visible air pollution and noxious odors. The remaining emissions can also condense on the inner walls of the exhaust flue, forming a potential fire hazard. While these pollutants are not currently regulated, the problem, particularly the threat of stack fires, is significant enough that some action needs to be taken.

One known approach to the problem of remediating the furnace exhaust stream is to collect the particulates in a baghouse or another physical filter. This approach is used to collect both combustible binders, such as zinc and lithium stearates, and noncombustible residues, such as zinc and lithium oxides. However, such constructions are prohibitively expensive for the typical small powder metallurgy facility. Furthermore, the exhaust stream must be significantly cooled before introduction into the filter, such that upstream condensation can still occur, with the consequent risk of stack fires. Filters also clog and require regular maintenance.

Another known way to try to remediate furnace emissions is to place an auxiliary natural gas or other burner directly in the exhaust stack, shortly downstream of the furnace, and simply combust the unburned hydrocarbons and other combustible pollutants as they exit the furnace. This does reduce the level of emissions in the stack exhaust. However, this has not been done properly. Specifically, adding significant additional heat from an added burner to a simple uninsulated exhaust stack creates an enormous draft, such that the furnace exhaust tends to be drawn through and out of the stack before the pollutants are fully combusted. The draft induced in such an arrangement can also draw the reducing gas out of the furnace, requiring its replacement and adding cost. Such auxiliary burner arrangements, as they have been used to date, have also been relatively inefficient and consume large quantities of additional fuel, adding significantly to the cost of sintering operations.

OBJECTS OF THE INVENTION

It is therefore apparent that the powder metallurgy industry, and related industries, require improved apparatus and methods for remediation of furnace exhaust gases, that is, for significantly reducing or disposing of undesirable combustible gases and pollutants, and other residues of the waxy hydrocarbon materials used as binder/lubricant compositions in sintering operations, and to provide these is a principal object of the invention.

More specifically, it is an object of the invention to provide apparatus and methods for remediation of exhaust streams from heat treatment and other furnaces, so that essentially any desired combustible binder material can be used.

To be commercially acceptable, any such unit should be economical to purchase and operate, that is, simple in construction and efficient in its use of fuel, as well as being easy to install and service, and such is accordingly a further object of the invention.

SUMMARY OF THE INVENTION

The present invention satisfies the needs of the art and the objects of the invention mentioned above, and others which will appear as the discussion below proceeds, by providing an auxiliary burner for combusting waxy hydrocarbons and other emissions in the exhaust stream from the furnace, as in the prior art, but optimized for efficient and substantially complete combustion of the waxy hydrocarbon residues emitted as the binder/lubricant is driven off in sintering of green powdered-metal parts. As noted, the same invention has applicability to treatment of exhaust streams from furnaces used in other industries.

According to the invention, measures are taken to ensure that the furnace exhaust remains in a combustion zone of at least a minimum temperature for an average residence time sufficient to ensure substantially complete combustion. In so doing the waxy binder materials are oxidized to significantly lesser amounts of essentially benign materials. For example, zinc stearates that would otherwise typically be emitted are oxidized to carbon dioxide, water, and zinc oxide, an essentially harmless powder. The design of the chamber within which the combustion takes place is also optimized to provide highly efficient combustion. The overall design of the unit is optimized so as to use as many standard components as possible, to reduce cost, and to simplify installation, proper use, and maintenance.

In the embodiment specifically described, the furnace exhaust remediation unit of the invention comprises a vertical combustion chamber of high-quality stainless steel, to resist corrosion in this hostile environment. However, the combustion chamber need not be vertical. The combustion chamber is lined with a thick layer of one or more types of highly efficient and durable insulation, so as to retain the heat of combustion within the combustion chamber, improving efficiency and reducing the consumption of fuel. Several options are provided to control the rate of flow of ambient air and furnace exhaust through the combustion chamber, permitting control of the average residence time of the particulates and other emissions. The auxiliary burner is arranged such that it provides a flame directed tangentially into the combustion chamber, so that a spiral motion is provided to the exhaust stream, ensuring efficient heat transfer between the flame and the emissions to be oxidized.

A standard gas burner of up to 600,000 BTU/hour capacity, essentially as used on domestic heaters and like appliances, is preferably used as the auxiliary burner, complete with its blower, gas control solenoid, pilot or igniter, and control circuit, to reduce initial cost and simplify repair when necessary. A thermocouple may be provided to monitor the temperature within the combustion chamber, to ensure the temperature is high enough to provide substantially complete combustion while not so high as to pose a safety problem. The entire assembly may be mounted on an intake hood secured over the inlet of the furnace, or may be suspended from the ceiling of the facility, and requires only fuel and electrical connection for operation, further simplifying installation.

BRIEF DESCRIPTION OF THE DRAWINGS

The invention will be better understood if reference is made to the accompanying drawings, in which.

DESCRIPTION OF THE PREFERRED EMBODIMENTS

Figure 1:
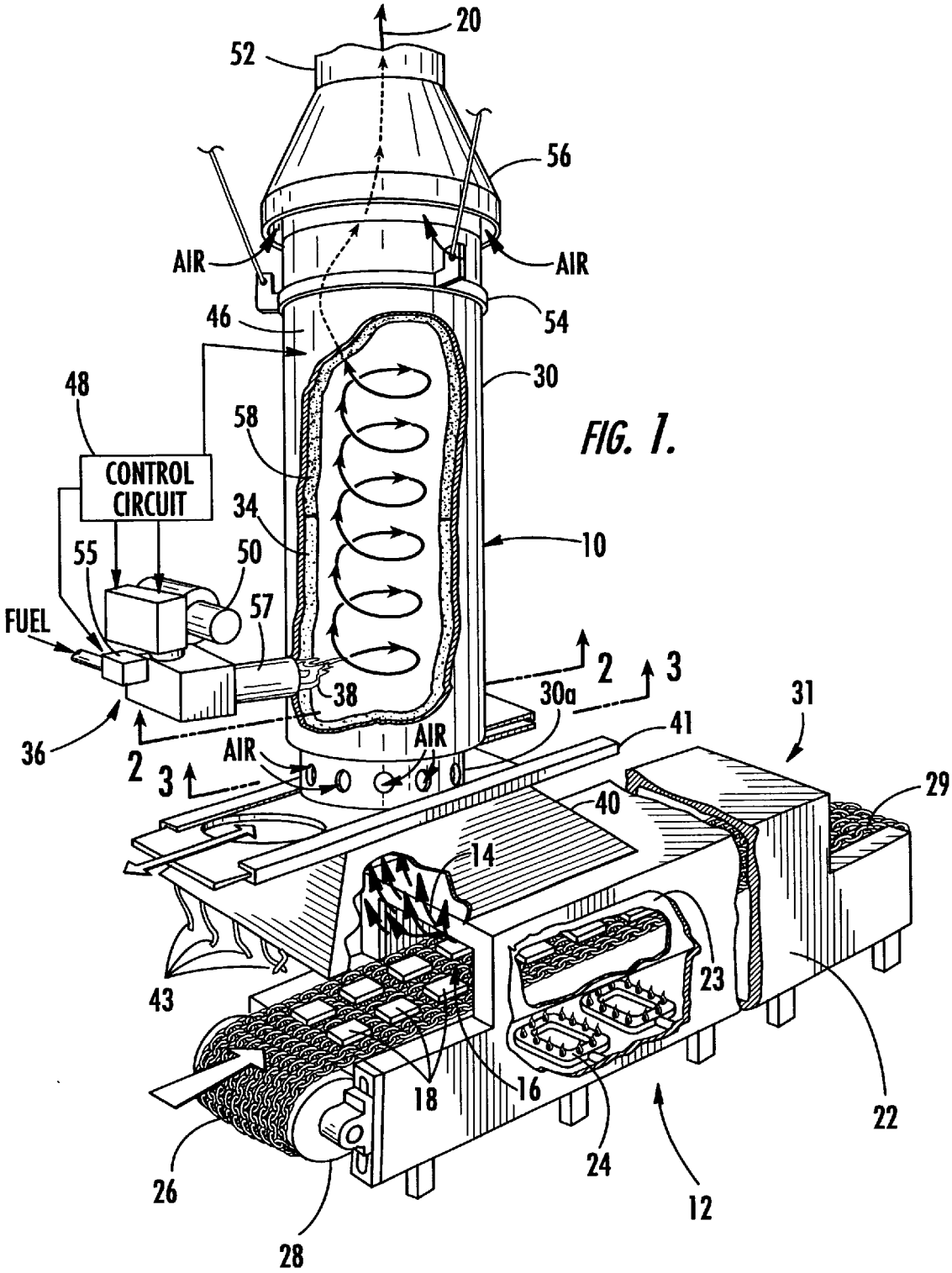
FIG. 1 is a perspective view, showing the furnace exhaust remediation unit of the invention mounted in juxtaposition to a sintering furnace of conventional design, illustrating the use of the invention to remediate exhaust from the furnace by combusting unburned hydrocarbon residues and other components of binder/lubricant materials driven off during sintering.

As discussed above, FIG. 1 shows one embodiment of the furnace exhaust remediation unit of the invention 10 in proximity to one type of conventional sintering furnace 12. More specifically, the exhaust remediation unit 10 is shown in a vertical embodiment, but is not limited thereto. Similarly, while the furnace 12 shown is a continuous-process type, the invention is not limited thereto; the invention also has application in other industries wherein exhaust streams contain combustible constituents that would desirably be remediated.

As shown, the exhaust 14 from the furnace 12 passes out an open intake window 16 and upwardly into remediation unit 10, in which hydrocarbons and other unburned residues of the binder/lubricant used in preparation of green parts 18 are combusted; the furnace exhaust, having thus been remediated to considerable extent by removal of these pollutants, is exhausted to the atmosphere at 20.

More particularly, the typical "continuous" Wintering furnace 12 comprises an elongated housing 22. Within housing 22 there is normally a second housing or "muffle" 23 containing a reducing atmosphere, such as hydrogen, nitrogen, natural gas, or dissociated ammonia, to prevent oxidation of the parts. A number of burners 24 are disposed beneath the muffle 23; these are supplied with natural gas or another fuel and when burning keep the temperature within the furnace 12 at on the order of 2300° F. Furnaces are also sometimes heated electrically. In the continuous-process furnace shown, green parts or "preforms" 18 to be sintered are placed on a slowly moving chain belt 26 near the intake window 16. Belt 26 extends between intake and outlet rollers 28 and 29 respectively, which are driven slowly, so that each green part experiences a residence time within furnace 12 of on the order of minutes or tens of minutes. The parts emerge from the exit end 31 of the furnace 12 and are typically ready for use. The invention also has applicability to non-continuous "batch" furnaces, in which parts to be treated are heated in an oven, in some cases for up to 60 hours; the problem of remediating the exhaust thereof to remove the binder/lubricant residues therefrom is essentially similar.

As noted above, in the typical powder metallurgical process, the green parts 18 are initially formed by placing a quantity of metal powders collectively providing the desired final composition of the completed part in a mold, together with on the order of 0.5–2% of a binder/lubricant substance. Commonly, waxy hydrocarbons such as lithium or zinc stearates make up the bulk of the binder/lubricant, although various processors use other substances, some of which are proprietary, and often add more or less of other compositions. The mixture of the powders and the binder/lubricant may be pressed into the mold, to ensure the mold is completely filled, and is typically subjected to a first low-temperature heat treatment, ensuring that the binder/lubricant penetrates all portions of the mold and bonds all of the grains of powder together, forming the green part. The green part is then removed from the mold and sintered, as illustrated in FIG. 1, by being subjected to high temperature heat treatment in furnace 12.

As also noted above, as the green parts enter furnace 12 and are heated, the binder/lubricant is vaporized. However, because the furnace is typically filled with a reducing (i.e., non-oxidizing) atmosphere, to prevent oxidization of the parts, essentially all of the vaporized binder/lubricant escapes unburned (albeit commonly partially decomposed)

and is entrained within a furnace exhaust stream exiting the intake end of the furnace, as illustrated at 14. Typically the unburned binder/lubricant takes the form of gases or vapors, i.e., the stearates, and may include particulates such as zinc oxide. If unremediated, these emissions will lead to visible smoke in the furnace exhaust, and noxious odors outside the plant. Moreover, as the hot exhaust gas travels out the flue, the unburned binder/lubricant can condense thereon, leading to buildup of flammable material and a significant risk of fire.

Figure 2:
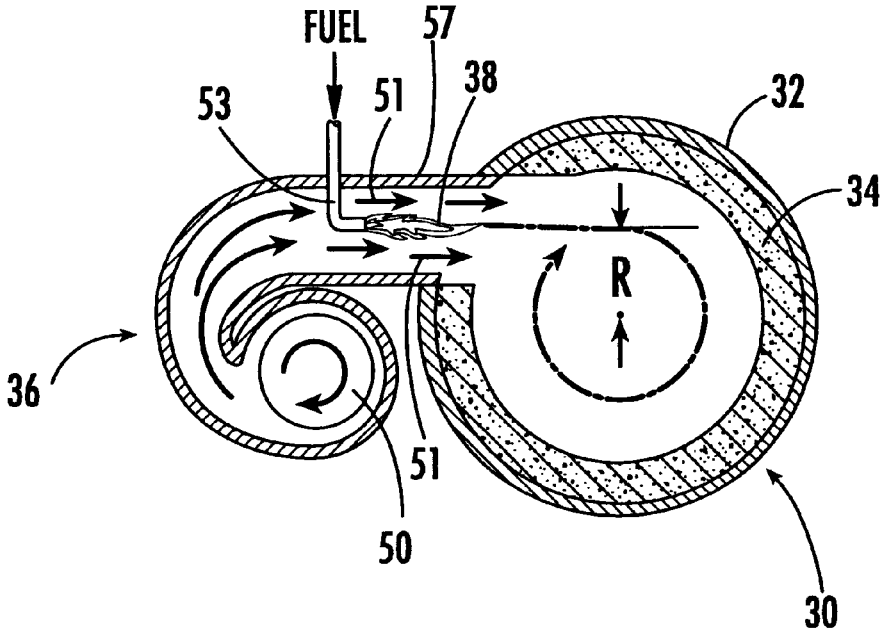
FIGS. 2 and 3 are cross-sectional views taken along lines 2—2 and 3—3 of FIG. 1, respectively.

Therefore, according to the invention, the furnace exhaust remediation unit of the invention 10 is disposed above the intake end of the furnace at 14, and is mounted on a hood 40 to collect the furnace exhaust from burners 24, along with the unburned binder/lubricant; the unit of the invention 10 typically replaces a section of the exhaust flue otherwise provided. As shown in FIGS. 1 and 2, unit 10 comprises a cylindrical combustion chamber 30, made up of an outer skin 32 of stainless steel, and lined with a high-efficiency insulative material 34 capable of withstanding the high temperatures (typically 1200–1800° F., as discussed in detail below) that are required to ensure substantially complete combustion of the unburned binder/lubricant. These temperatures are provided by an auxiliary burner assembly 36 mounted near the bottom of chamber 30, which injects a flame 38 into the upward-moving stream of furnace exhaust exiting the furnace 12, including the unburned binder/lubricant.

As noted above, substantially complete combustion of the unburned binder/lubricant can be ensured if the binder/lubricant remains in the combustion chamber for a sufficiently long average residence time, and if the temperature thereof is raised sufficiently high. To ensure effective heating of the binder/lubricant materials, the high-energy flame 38 provided by the auxiliary burner assembly 36 is directed off-axis, as shown in FIG. 2; that is, the flame 38 is not directed directly into the center of the combustion chamber, but is introduced "tangentially", so that a spiral flow is induced in the furnace exhaust. Thus inducing a spiral flow in the furnace exhaust ensures effective heat transfer between the binder/lubricant and the flame 38 from burner 36, and thus complete combustion.

As noted, in order to ensure substantially complete combustion it is important to heat the furnace exhaust to a sufficiently high temperature and maintain it there for a sufficient residence time. According to an important aspect of the invention, the residence time is controlled by controlling the rate of flow of ambient air into the combustion chamber. That is, some ambient air will necessarily flow into the lower end of combustion chamber 30, since it is not sealed to the furnace. As the ambient air is heated by flame 38, it will expand and rise, due to convection, while cooling the exhaust gases from furnace 12, which are efficiently collected by hood 40. If the rate of flow of inlet air—more particularly, the relative rate of flow of ambient air and furnace exhaust—is not controlled, the binder/lubricant materials may be cooled sufficiently to interfere with their efficient combustion. That is, if the ambient air intake is not carefully controlled, the burner 36 may not be able to supply enough energy to reach the required exhaust temperature of 1200–1700° F. to ensure substantially complete combustion. Moreover, uncontrolled flow of ambient air results in excessive draft through the furnace, wasting the reducing gas.

Figure 3:
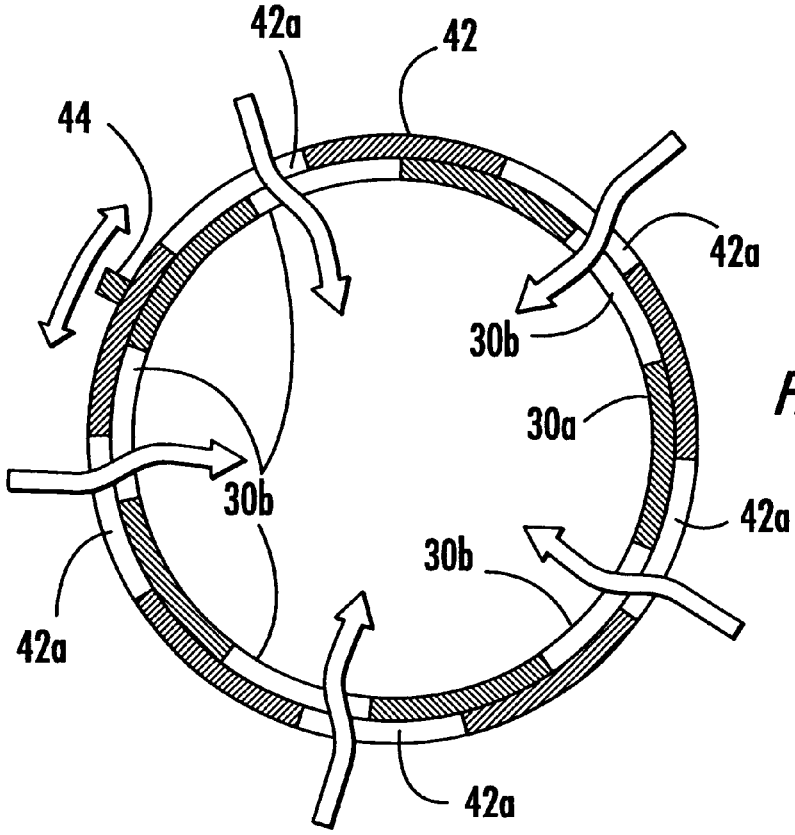
Figure 4:
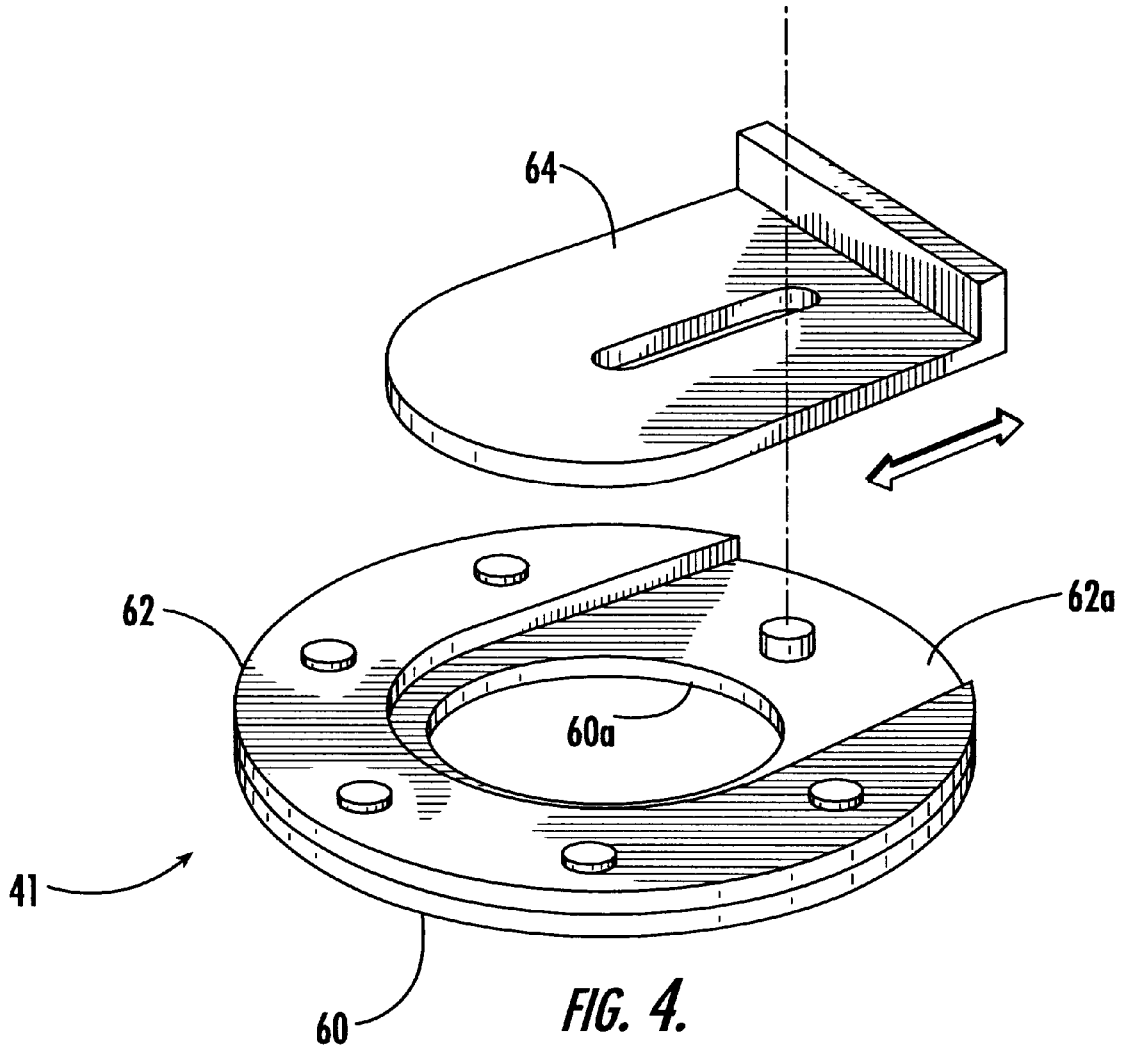
FIG. 4 is a perspective view of a preferred slide gate valve used to control the draft through the exhaust remediation unit of the invention.

FIGS. 3 and 4 show simple valve devices for controlling the rate of flow of ambient air and the furnace exhaust into the combustion chamber, respectively. Other devices for doing so are within the skill of the art and the invention. FIG. 3 is a cross-sectional view through a cylindrical lower portion 30*a* of the combustion chamber 30 of relatively reduced diameter. A ringlike member secured at its outer periphery to wall 30 and at its inner periphery to portion 30*a* provides structural support for the latter, as well as for insulation 34. An intake hood 40 below allows substantially complete collection of the furnace exhaust and can also be used to support the combustion chamber assembly. As indicated, portion 30*a* is perforated at a number of locations 30*b*. An outer ring 42 fits relatively closely around portion 30*a*, and is perforated similarly at 42*a*. Ring 42 can be rotated around portion 30*a*, using a gripping handle 44, so as to control the degree to which perforations 30*b* and 42*a* are aligned, and thus to control the amount of relatively cooler ambient air admitted therethrough. In many circumstances ring 42 may be aligned so that little or no ambient air is admitted at this point.

FIG. 1 shows a first embodiment of a slide gate valve 41 disposed between hood 40 and combustion chamber 30 as a throttle, i.e., to control the amount of ambient air drawn into the combustion chamber 10 together with the exhaust stream, while FIG. 4 shows a preferred embodiment thereof. A butterfly valve—that is, a circular disc adapted to pivot about a horizontal axis—may also be used in lieu of slide gate valve 41. The embodiment of slide valve 41 shown in FIG. 4 comprises a first circular disc 60, having a hole 60*a* in its center, a second partial disc 62 bolted thereto, and a slide member 64. Slide member 64 is supported by the portion of disc 60 surrounding hole 60*a*, and fits within a cutout portion 62*a* of partial disc 62, so as to be slid radially inwardly, to close the valve, or outwardly to open it. Slide gate valve 41 is thus used to control the amount of heated ambient air that is entrained with furnace exhaust 14. In general, valve 41 is controlled so that the minimum possible amount of ambient air is drawn in, so as to reduce the draft of the combustion chamber as much as possible, and thereby maximize the residence time of the exhaust stream and ensure complete combustion. The amount of ambient air being drawn in can be readily monitored by observing the position of light streamers 43 of heat-resistant fibers or the like attached to the mouth of hood 40; the valve 41 is opened just until the streamers are drawn slightly into the mouth of hood 40, indicating that a minimum amount of ambient air is being drawn into combustion chamber 30.

As illustrated by FIG. 1, the upper end of combustion chamber 30 is open; it is preferably spaced a few inches from the larger open mouth of a hood 56 connected to the facility flue 52, so that cooling air can be drawn into and entrained with the remediated furnace exhaust exiting combustion chamber 30. This reduces the draft in combustion chamber 30; excessive draft within combustion chamber 30 would tend to draw the reducing gases out of furnace 12 at a rate sufficient to increase the cost of their supply significantly. Reducing the draft also increases the residence time of the exhaust gases therein, as noted above. Providing cooling air as the exhaust gases enter hood 56 also reduces the temperature of gases entering flue 52, so that the flue can be fabricated of ordinary galvanized steel. The assembly of the combustion chamber and auxiliary burner 36 can conveniently be suspended from the ceiling of the facility by a ring-like bracket 54, or from hood 56 and flue 52, or may be supported directly on the furnace itself.

Returning to discussion of the specifics of the furnace exhaust remediation unit of the invention 10, as noted the auxiliary burner assembly 36 can conveniently comprise a conventional natural-gas or propane burner unit of up to 600,000 BTU/hour capacity, as used on domestic heaters and the like. Such units are of course in wide use, are adequately reliable and readily reparable. Further, such conventional burner units 36 comprise an integrated motor and blower 50, to provide sufficient air for proper combustion. The flame 38 created by burner 36 may also help induce the desired spiral flow pattern, as discussed further below. Such conventional burner units also comprise a solenoid valve 55 (FIG. 1) for controlling gas flow, and a pilot or igniter for lighting gas or other fuel issuing from a nozzle 53, such that a flame 38 is provided. A control circuit 48, essentially identical to the circuitry used for controlling such units in domestic service, can be employed to control auxiliary burner 36. If desired, the conventional burner control circuit may be made responsive to a thermocouple 46 having a sensor disposed within combustion chamber 30, allowing control of the precise temperature therein.

As stated above, increased residence times at specified high temperatures are frequently desirable and/or necessary to treat the compounds traveling through the system which are more difficult to oxidize, such as ammonia gas and some aromatic compounds. To achieve these increased residence times, the size of the furnace emission remediation system must be increased to handle a large exhaust throughput and/or to allow for longer residence times at high temperature. As can be understood, the combustion chamber 30 can be increased in diameter and in length to thereby increase residence times. Further, the size and capacity of the burner 36 can be similarly increased.

However, while a very long combustion chamber 30 (e.g. 100 inches) and high capacity burner 36 may be theoretically desirable, such a long combustion chamber 30 and burner 36 are difficult to transport and install at a given processing site. In accordance with the alternative embodiment of the present invention shown in FIG. 5, the furnace emission remediation system 10 of the preferred embodiment of the present invention of FIG. 1, namely the combustion chamber 30 and burner 36, may be constructed of modular components to allow for easy customization of the system to meet application demands.

Figure 5:
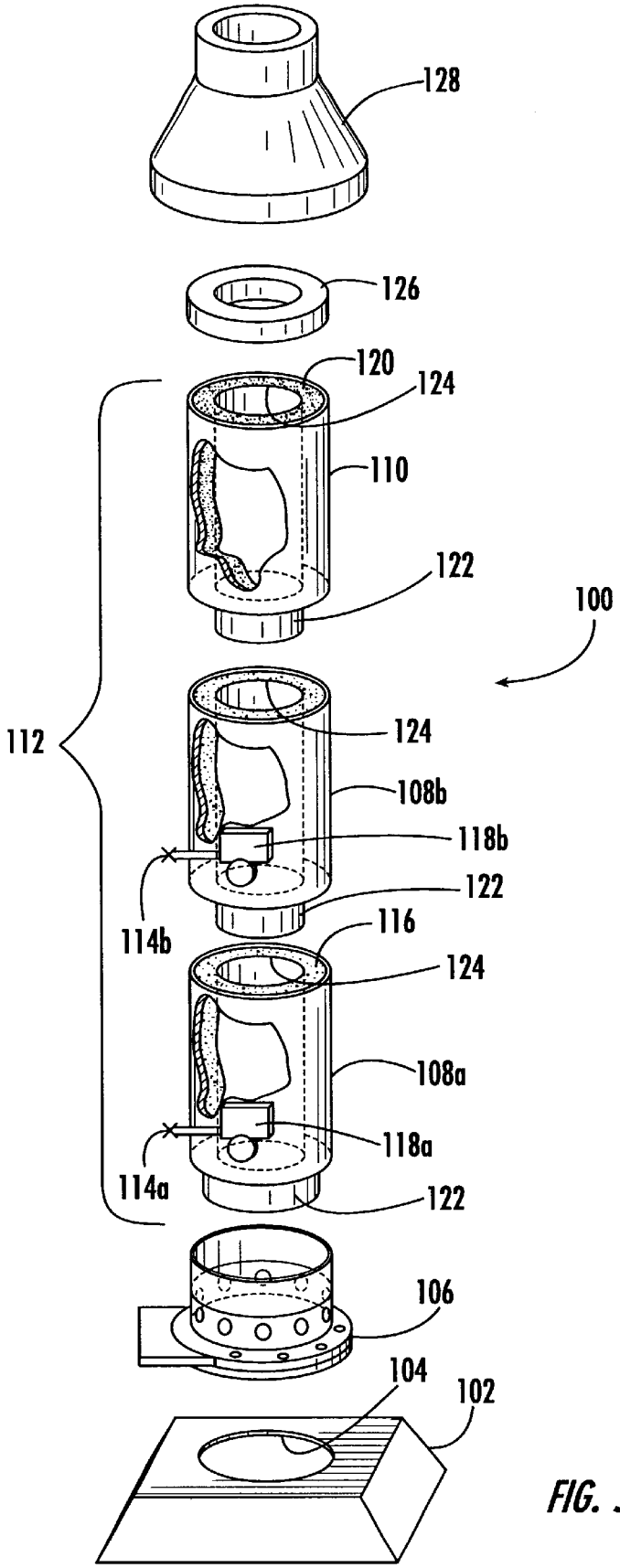
FIG. 5 is a perspective view of an alternative embodiment of the furnace exhaust remediation unit of the present invention with a modular stack configuration.

As shown in FIG. 5, the furnace emission remediation system 100 of the alternative embodiment includes a hood 102 with an aperture 104 which resides over a furnace (not shown in FIG. 5), such as the furnace 12 shown in FIG. 1. A slide gate module 106 interfaces with aperture 104 through the top of the hood 102 to control the flow of emissions from the furnace. Slide gate module 106 operates in similar fashion to the slide gate 41 of FIG. 4.

In contrast to the unitary combustion chamber 30 of FIG. 1, the alternative embodiment 100 of FIG. 5 includes a number of stackable modules 108*a,* 108*b* and 110 to enable a combustion chamber 112 to be constructed and installed to the specifications of the application at hand. A stackable universal burner module 108*a* is provided with a burner inlet 114*a* and lined with rigid refractory material 116*a* which is able to withstand the flame abrasion from a tangentially mounted burner flame 118*a*. For example, this universal burner module 108*a* may be 36 inches in length while keeping the same diameter as the combustion chamber 30 of the preferred embodiment of FIG. 1. By way of example, a second burner module 108*b* is also provided in communication with the first burner module 108*a*. The second burner module also includes a burner inlet 114*b* and burner flame 118*b*.

Also provided is a combustion chamber extension module 110 which is lined with a formed refractory or rigidized ceramic blanket 120. The extension module 110 is stackable and can be constructed of different lengths, such as 24 inches and 36 inches. Other lengths of the modules 108*a,* 108*b* and 110 may be employed and still be within the scope of the present invention. Each of the modules 108*a,* 108*b* and 110 are provided with a reduced neck portion 122 for engagement with the respective apertures 124 in the top of the adjacent module to facilitate stacking. A top cap 126 and a top hood 128 are provided at the top of the system 100 to direct processed emissions to the environment.

By way of example, FIG. 5 illustrates the use of two burner modules 108*a* and 108*b* stacked on one another with an extension module 110 stacked thereon to suit a given application. In this example, the two burner modules 108*a* and 108*b* are desired in a row. Thus, the number, length and order of the burner modules 108*a* and 108*b* and extension module(s) 110 may be varied to suit the application at hand.

The modular construction of the alternative embodiment of the furnace emission remediation system 100 of FIG. 5 allows for maintaining the small footprint of the original furnace emission remediation system 10 while permitting expansion vertically using separate stackable modules 108*a,* 108*b* and 110. This unique modular construction permits easy assembly and take-down and simplified after-market modification of installation to meet new environmental regulations. The ability to swap out modules greatly facilitates performing service on the system, such as cleaning, repairing and replacement of the refractory material in each module.

With the understanding that the invention is not to be thus limited, the invention has been successfully tested in an embodiment wherein the combustion chamber 30 is a unitary body approximately 50 inches high, from the top of the hood 40 to the open upper end thereof. As discussed above in connection with the alternative embodiment of the system 100 of FIG. 5, the combustion chamber 112 may be broken up into separate modules 108*a,* 108*b* and 110 for ease of transport and installation. The outer skin 32 is of type 304 stainless steel, 16 gauge, and is 16 inches in outside diameter. A layer of insulation 34 two inches thick is provided to ensure that the combustion chamber can be maintained at the desired combustion temperature with minimal fuel usage. Good results have been obtained using a vacuum-formed rigidized high-temperature refractory ceramic liner 56 rated to 2300° F. (e.g., as available from the Unifrax Corporation of Niagara Falls, N.Y.) in the lower 20 inches of the combustion chamber, which has abrasion resistance to flame impingement from the burner 36. A rigidized high-temperature insulated fabric liner 58 formed of two two-inch-thick layers of Kaowool material (available from the Thermal Ceramics Company of Augusta, Ga.) may be used in the upper portion of the chamber, which is somewhat cooler.

Successful tests have been performed using this combustion chamber 30 and several natural gas-fired auxiliary burners of 75,000–300,000 BTU/hour capacity, as used in domestic appliances. The burner 36 is mounted to the combustion chamber 30 by a burner tube 57 of 4.25 inches outside diameter, located such that the flame 38 is centered 6.5 inches above the reduced-diameter portion 30*a* of the combustion chamber, and aligned such that dimension R (FIG. 2), representing the distance between the flame axis defined by nozzle 53 and the cylindrical axis of combustion chamber 30, is four inches. Variation in these dimensions, as well as use of other fuels and other types of auxiliary burner, are of course within the scope of the invention where not excluded by the following claims.

Experimental results to date indicate that at least about 90% of the unburned hydrocarbons, that is, the binder/ lubricant, in the exhaust from a typical sintering furnace are removed therefrom by the furnace exhaust remediation unit of the invention as described above if an average temperature of 1200–1400° F. and an average residence time of about 0.4 seconds are maintained, which thus form the present optimum mode of practice of the invention. Natural gas was combusted in auxiliary burner 36 at a rate of 75,000 BTU/hour in performance of these tests.

It will be apparent to those of skill in the art that these figures can vary relatively widely while achieving substantial remediation; more specifically, if the average temperature is higher, the average residence time can be shorter, and vice versa. For the purposes of the present invention, a residence time of about 0.3–0.4 seconds is considered to be minimally effective in remediating furnace exhaust by combustion, and a residence time of 1.5–2.0 seconds should be sufficient under most circumstances. Similarly, the average temperature within the combustion chamber (which will vary somewhat within the chamber, being hottest in the vicinity of the flame, and cooler above) should be at least about 1200° F., while temperatures above about 1800° F. are unnecessary, and lead to excessive formation of $NO_x$.

It will be apparent that the residence time experienced by the unburned hydrocarbons entrained with the furnace exhaust stream 14 is controlled at least in part by the relative rates of flow of the furnace exhaust 14 and the flame 38. Stated differently, the extent to which the convection-driven vertical flow of the furnace exhaust 14 into the combustion chamber 30 is converted to a spiral flow by the influence of flame 38 is a function of the relative energy contents of the furnace exhaust 14 and the flame 38.

The furnace exhaust 14 is typically of relatively low energy, as it flows at low velocity (typically 1000–6000 cfh), being driven only by convection due to the heating of the atmosphere within furnace 12, and by supply of the reducing gas, provided to ensure a slight overpressure to exclude ambient air from the interior of the furnace, as noted above, and is of relatively low temperature (typically 400–900° F. as it enters the combustion chamber). That is, the furnace exhaust is insufficiently hot to combust all of the unburned hydrocarbons, although some burning does take place when the furnace exhaust mixes with ambient air upon exit from the furnace intake window 16 and the unburned hydrocarbons are thus exposed to oxygen.

By comparison, the flame 38 is of much higher energy than the furnace exhaust stream, as it is both hotter and of substantially higher velocity than the furnace exhaust stream, and is therefore relatively effective in converting the vertical flow of the furnace exhaust to spiral motion, thus ensuring thorough mixing of the furnace exhaust and entrained unburned hydrocarbons with the flame to ensure efficient heat transfer and thus substantially complete combustion thereof.

More specifically, the exhaust gas stream entering the combustion chamber is typically at around 400–900° F., is heated to 1400–1600° F. by the flame 38 provided by burner 36 and by combustion of the waxy hydrocarbon emissions, is cooled to 1200–1400° F. by the time it exits the combustion chamber, and is further significantly cooled, e.g. to on the order of 800° F., by ambient air mixed therewith in the exhaust hood 56.

As noted, in order to ensure substantially complete combustion of the waxy hydrocarbons, it is important that the exhaust stream experience at least a minimum average residence time at a sufficiently high temperature. It will be apparent to those of skill in the art that measuring the average residence time of the furnace exhaust and entrained unburned hydrocarbons within the combustion chamber is not necessarily a simple matter, and moreover that this quantity is important in defining the invention. "Average residence time" as used herein, and in the appended claims, may be approximated responsive to measurement of the amount of reducing gas admitted to the furnace, which can be determined using conventional flow metering techniques.

In the following Table I, various values for the flow of the reducing gas (measured at room temperature, i.e., on admission to the furnace) are given in the left column; the center column shows the expanded volume of the gas that occurs on heating to 1400° F., and the right column shows calculated values for the average residence time of the gas in the combustion chamber as specified above, assuming that all of the reducing gas in fact enters the combustion chamber. Table I thus allows approximation of the average residence time as a function of the flow rate of the incoming reducing gas and the temperature within the combustion chamber, both of which can be readily measured. Note that the residence time as thus calculated is not corrected for the additional volume of gas provided by the burner 36.

TABLE I

| Flow (SCFH) | Flow (ACFH @1400° F.) | Avg. Res. Time (sec.) |
|---|---|---|
| 1,000 | 3,510 | 2.9 |
| 1,500 | 5,200 | 2.0 |
| 2,000 | 7,020 | 1.5 |
| 2,500 | 8,775 | 1.2 |
| 3,000 | 10,530 | 1.0 |
| 3,500 | 12,285 | 0.84 |
| 4,000 | 14,040 | 0.73 |
| 4,500 | 15,790 | 0.65 |
| 5,000 | 17,545 | 0.59 |
| 5,500 | 19,300 | 0.53 |
| 6,000 | 21,055 | 0.49 |
| 6,500 | 22,810 | 0.45 |

Experimental results to date, analyzing the constituents of the gas exiting the combustion chamber using an ECOM gas analyzer (i.e., using decreased hydrocarbon content as a measure of the completeness of combustion), an opacity meter, and odor assessment, indicate that if the temperature at the upper section of the combustion chamber is maintained at about 1400° F. (so that the temperature in the vicinity of the burner is probably on the order of 1600° F.), and if the average residence time is maintained at least 0.4 seconds (determined as above) the waxy hydrocarbons and objectionable odors otherwise present in the exhaust streams from powder metallurgy furnaces are substantially combusted and eliminated. However, it is believed that the benefits of the invention can be substantially obtained at lower average temperatures and shorter average residence times, possibly as little as 0.3 seconds at 1200° F., again measured at the upper portion of the combustion chamber; it will be appreciated that as the residence time is reduced the combustion temperature must be raised proportionally to ensure substantially complete combustion.

While a preferred embodiment of the invention has been shown and described in detail, the invention is not to be limited thereby, but only by the following claims. In particular, while the invention has been described in connection with remediation of exhaust streams from sintering furnaces as used in powder-metallurgical processes, the invention has application elsewhere, and is accordingly not thus limited.

What is claimed is:

1. An exhaust remediation system for combusting unburned combustible pollutants entrained in relatively low temperature exhaust streams, comprising:

a first combustion chamber of a generally cylindrical configuration including an insulated cylindrical shell defining an open inlet orifice and an open outlet orifice; said first cylindrical combustion chamber defining a first interior volume therein;

a fuel burner assembly, comprising a fuel nozzle, a control device for controlling supply of combustible fuel, means for Igniting said fuel, and a blower for forcing a stream of ambient air around fuel issuing from said nozzle, so as to create a relatively high-temperature flame;

said fuel burner assembly being mounted to said first combustion chamber, spaced from said open inlet orifice and aligned such that said high-temperature flame is directed substantially tangentially into said first combustion chamber through said cylindrical shell and between said Inlet orifice and said outlet orifice, not at the cylindrical axis thereof;

a second combustion chamber of a generally cylindrical configuration including an insulated cylindrical shell defining an open inlet orifice and an open outlet orifice; said second cylindrical combustion chamber defining a second interior volume therein; said second combustion chamber being attached to said first combustion chamber connecting said first interior volume with said second interior volume thereby extending and expanding said first interior volume;

means for controlling the rate at which one of both of ambient air and said exhaust stream flow into the Inlet orifice of said first combustion chamber; said means for controlling the rate being connected to said inlet orifice;

whereby the combination of said high-temperature flame and said exhaust stream traverses a generally spiral flow path within said first combustion chamber and said second combustion chamber with said spiral flow path filling substantially said entire interior volume of said first combustion chamber and said second combustion chamber; and wherein said unburned combustible pollutants experience a maximum average residence time in a portion of said first combustion chamber and said second combustion chamber that is heated by combustion of said fuel in said fuel burner assembly to a temperature sufficient to substantially combust said unburned combustible pollutants.

2. The exhaust remediation system of claim 1, wherein said first combustion chamber is disposed with its cylindrical axis vertical, with its inlet orifice at its respective lower end and its respective outlet orifice at its upper end; and said first combustion chamber is disposed with its cylindrical axis vertical, with its inlet orifice at its respective lower end and its respective outlet orifice at its upper end.

3. The exhaust remediation system of claim 1, further comprising a thermocouple having a sensor disposed in said first combustion chamber and connected to said control device for controlling supply of combustible fuel so as to maintain the temperature within said first combustion chamber and said second combustion chamber at a desired temperature.

4. The exhaust remediation system of claim 1, wherein said means for controlling the rate at which one or both of ambient air and exhaust flow into said first combustion chamber includes an ambient air control valve disposed above the open lower orifice of said first combustion chamber and below said fuel burner assembly.

5. The exhaust remediation system of claim 1, wherein said means for controlling the rate is a valve.

6. The exhaust remediation system of claim 1, wherein said open outlet orifice of said first combustion chamber is spaced from a open mouth of a hood connected to a flue, such that ambient air can flow into said hood and flue, cooling the remediated exhaust stream passing into said flue.

7. An exhaust remediation system for combusting unburned combustible pollutants, comprising:

a first combustion chamber of a generally cylindrical configuration including an insulated cylindrical shell defining an open inlet orifice and an open outlet orifice;

said first cylindrical combustion chamber defining a first interior volume therein;

a first fuel burner assembly, comprising a fuel nozzle, a control device for controlling supply of combustible fuel, means for igniting said fuel, and a blower for forcing a stream of ambient air around fuel issuing from said nozzle, so as to create a relatively high-temperature flame;

said first fuel burner assembly being mounted to said first combustion chamber, spaced from said open inlet orifice and aligned such that said high-temperature flame is directed substantially tangentially into said first combustion chamber through said cylindrical shell and between said inlet orifice and said outlet orifice, not at the cylindrical axis thereof;

a second combustion chamber of a generally cylindrical configuration including an insulated cylindrical shell defining an open inlet orifice and an open outlet orifice; said second cylindrical combustion chamber defining a second interior volume therein;

a second fuel burner assembly, comprising a fuel nozzle, a control device for controlling supply of combustible fuel, means for igniting said fuel, and a blower for forcing a stream of ambient air around fuel issuing from said nozzle, so as to create a relatively high-temperature flame;

said second fuel burner assembly being mounted to said second combustion chamber, spaced from said open inlet orifice and aligned such that said high-temperature flame is directed substantially tangentially into said second combustion chamber through said cylindrical shell and between said inlet orifice and said outlet orifice, not at the cylindrical axis thereof; said second combustion chamber being attached to said first combustion chamber connecting said first interior volume with said second interior volume thereby extending and expanding said first interior volume;

means for controlling the rate at which one of both of ambient air and said exhaust stream flow Into the inlet orifice of said first combustion chamber and said second combustion chamber; said means for controlling the rate being connected to said inlet orifice of said first combustion chamber and said inlet orifice of said second combustion chamber;

whereby the combination of said high-temperature flame and said exhaust stream traverses a generally spiral flow path within said first combustion chamber and said second combustion chamber with said spiral flaw path filling substantially said entire interior volume of said first combustion chamber and said second combustion chamber; and wherein said unburned combustible pollutants experience a maximum average residence time in a portion of said first combustion chamber and said second combustion chamber that is heated by combustion of said fuel in said fuel burner assembly to a temperature sufficient to substantially combust said unburned combustible pollutants.

8. The exhaust remediation system of claim 7, wherein said first combustion chamber and said second combustion chamber are disposed with their respective cylindrical axes vertical, with their respective inlet orifices at their respective lower ends and their respective outlet orifices at their respective upper ends; said outlet orifice of said first combustion chamber being in fluid communication with said inlet orifice of said second combustion chamber.

9. The exhaust remediation system of claim 7, further comprising:

a first thermocouple having a sensor disposed in said first combustion chamber and connected to said control device for controlling supply of combustible fuel so as to maintain the temperature within said first combustion chamber at a desired temperature; and a second thermocouple having a sensor disposed in said second combustion chamber and connected to said control device for controlling supply of combustible fuel so as to maintain the temperature within said second combustion chamber at a desired temperature.

10. The exhaust remediation system of claim 7, wherein said means for controlling the rate at which one or both of ambient air and exhaust flow into said first combustion chamber includes an ambient air control valve disposed above the open lower orifice of said first combustion chamber and below said fuel burner assembly.

11. The exhaust remediation system of claim 7, wherein said means for controlling the rate is a valve.

12. The exhaust remadiation system of claim 7, wherein said open outlet orifice of said first combustion chamber is spaced from an open mouth of a hood connected to a flue, such that ambient air can flow into said hood and flue, cooling the remediated exhaust stream passing into said flue.

* * * * *